US010772471B2

(12) United States Patent
Fine

(10) Patent No.: US 10,772,471 B2
(45) Date of Patent: Sep. 15, 2020

(54) APPARATUS FOR SECURING A COLLAPSIBLE WATER DAM

(71) Applicant: Alizach Holdings, Inc., Inglewood, CA (US)

(72) Inventor: Adam Fine, Inglewood, CA (US)

(73) Assignee: ALIZACH HOLDINGS, INC., Inglewood, CA (US)

( * ) Notice: Subject to any disclaimer, the term of this patent is extended or adjusted under 35 U.S.C. 154(b) by 229 days.

(21) Appl. No.: 15/141,766

(22) Filed: Apr. 28, 2016

(65) Prior Publication Data

US 2017/0311764 A1 Nov. 2, 2017

(51) Int. Cl.
*A47K 3/40* (2006.01)
*A47K 3/30* (2006.01)

(52) U.S. Cl.
CPC ..... *A47K 3/405* (2013.01); *A47K 3/302* (2013.01)

(58) Field of Classification Search
CPC . A47K 3/14; A47K 3/40; A47K 3/302; A47K 3/405; A47K 3/008; E06B 1/70; E06B 7/16; E06B 3/9632
USPC ..... 4/609, 613; 49/467–471, 498.1; 52/287.1, 34–35
See application file for complete search history.

(56) References Cited

U.S. PATENT DOCUMENTS 2,090,588 A * 8/1937 Witsell ..... A47K 3/008 4/538
3,451,178 A * 6/1969 Beale ..... E06B 7/16 4/612
4,189,790 A * 2/1980 Masters, III ..... A47K 3/30 4/559
4,617,209 A * 10/1986 Ives ..... B60R 13/04 293/128
4,706,427 A * 11/1987 Zeilinger ..... A47K 3/001 52/287.1
4,829,730 A * 5/1989 Zeilinger ..... A47K 3/001 52/287.1
4,948,637 A * 8/1990 Kessler ..... B60R 13/04 293/128
5,033,244 A * 7/1991 Ullman ..... A47B 13/083 52/288.1
5,252,376 A * 10/1993 Greenberg ..... A47B 13/083 293/128
6,006,375 A * 12/1999 Carr ..... A47K 3/40 4/609
7,055,188 B2 * 6/2006 Ross ..... A47K 3/405 4/609

(Continued)

OTHER PUBLICATIONS

Water Stopper Installation Instructions; available May 9, 2009; https://www.acessinc.com/documents/WaterStopperInstructions.pdf.*

*Primary Examiner* — Lori L Baker
(74) *Attorney, Agent, or Firm* — Cotman IP Law Group

(57) ABSTRACT

An apparatus for securing a collapsible water dam is an end-cap with a semi-cylindrical housing. The end-cap further includes a side flange coupled to each side of the housing at the bottom periphery of the outside wall of housing. The end-cap further includes a barrier wall inside the housing that creates a secure chamber for housing a collapsible water dam. The end-cap further includes a wall flange at the distal end of the housing. The wall flange couples to and joins both side flanges in a configuration that provides a tight fit with the end wall of a shower.

5 Claims, 14 Drawing Sheets

(56) References Cited

U.S. PATENT DOCUMENTS

| | | | | |
|---|---|---|---|---|
| 7,118,791 | B2 * | 10/2006 | Martel | A47K 3/008<br>403/231 |
| 9,408,501 | B2 * | 8/2016 | Erlebach | A47K 3/40 |
| 2006/0231542 | A1 * | 10/2006 | Kienle | A47K 3/30<br>219/209 |
| 2012/0030871 | A1 * | 2/2012 | Eriksson | A47K 3/302<br>4/609 |

* cited by examiner

APPARATUS FOR SECURING A COLLAPSIBLE WATER DAM

BACKGROUND OF THE INVENTION

Field of the Invention

Embodiments of the invention relates to the field of barrier retainers. More specifically, the invention relates to an apparatus for securing a collapsible water dam.

Description of the Related Art

Collapsible water dams (also known as Shower Water Retainer) prevents water from escaping out of a roll-in or barrier-free shower stall. In its normal or resting state, a collapsible water dam stands approximately 1.25 inches high but collapses to approximately ⅜ inches when stepped on or rolled over, e.g. by a wheelchair, and returning to its resting or normal state thereafter.

Health workers appreciate the extra safety provided by our shower water retainer. Safety is increased by retaining water in the shower areas to keep the rest of the area dry preventing slips. Collapsible shower water retainer dams are ideal for roll in, barrier free, and curbless shower stalls.

The water retainer dam is made of a high density memory material that returns to its original shape after it has been rolled or stepped on. End caps or plugs are used to anchor the water dam to the wall, i.e. where the wall meets the shower base.

BRIEF SUMMARY OF THE INVENTION

One or more embodiments of the invention are directed to an apparatus for securing a collapsible water dam. Embodiments of the present invention provide a tight fit enclosure for the ends of collapsible shower dams to keep water out and create more stability.

Embodiments of the invention comprise an end-cap with a semi-cylindrical housing. The housing includes a chamber at its proximal end for securing the collapsible water dam.

In one or more embodiments, the end-cap further includes a side flange coupled to each side of the housing at the bottom periphery of the outside wall of housing.

In one or more embodiments, the end-cap further includes a barrier wall inside the housing that creates a secure chamber for housing a collapsible water dam. The secure chamber includes a slot on each side of the inside periphery of the housing to secure a bottom wall of the collapsible water dam.

In one or more embodiments, the end-cap further includes a wall flange at the distal end of the housing. The wall flange couples to and joins both side flanges in a configuration that provides a tight fit with the end wall of a shower. The wall flange may be configured to fit a 90-degree end wall or a curved end-wall.

In one or more embodiments, the end cap comprises a thermoplastic elastomer material such as a thermoplastic vulcanizate (TPV).

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION

The present invention comprising an apparatus for securing a collapsible water dam will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. Furthermore, although steps or processes are set forth in an exemplary order to provide an understanding of one or more systems and methods, the exemplary order is not meant to be limiting. One of ordinary skill in the art would recognize that the steps or processes may be performed in a different order, and that one or more steps or processes may be performed simultaneously or in multiple process flows without departing from the spirit or the scope of the invention. In other instances, specific features, quantities, or measurements well known to those of ordinary skill in the art have not been described in detail so as not to obscure the invention. It should be noted that although examples of the invention are set forth herein, the claims, and the full scope of any equivalents, are what define the metes and bounds of the invention.

For a better understanding of the disclosed embodiment, its operating advantages, and the specified object attained by its uses, reference should be made to the accompanying drawings and descriptive matter in which there are illustrated exemplary disclosed embodiments. The disclosed embodiments are not intended to be limited to the specific forms set forth herein. It is understood that various omissions and substitutions of equivalents are contemplated as circumstances may suggest or render expedient, but these are intended to cover the application or implementation.

The term "first", "second" and the like, herein do not denote any order, quantity or importance, but rather are used to distinguish one element from another, and the terms "a" and "an" herein do not denote a limitation of quantity, but rather denote the presence of at least one of the referenced item.

One or more embodiments of the present invention will now be described with references to FIGS. 1-8.

Figure 1:
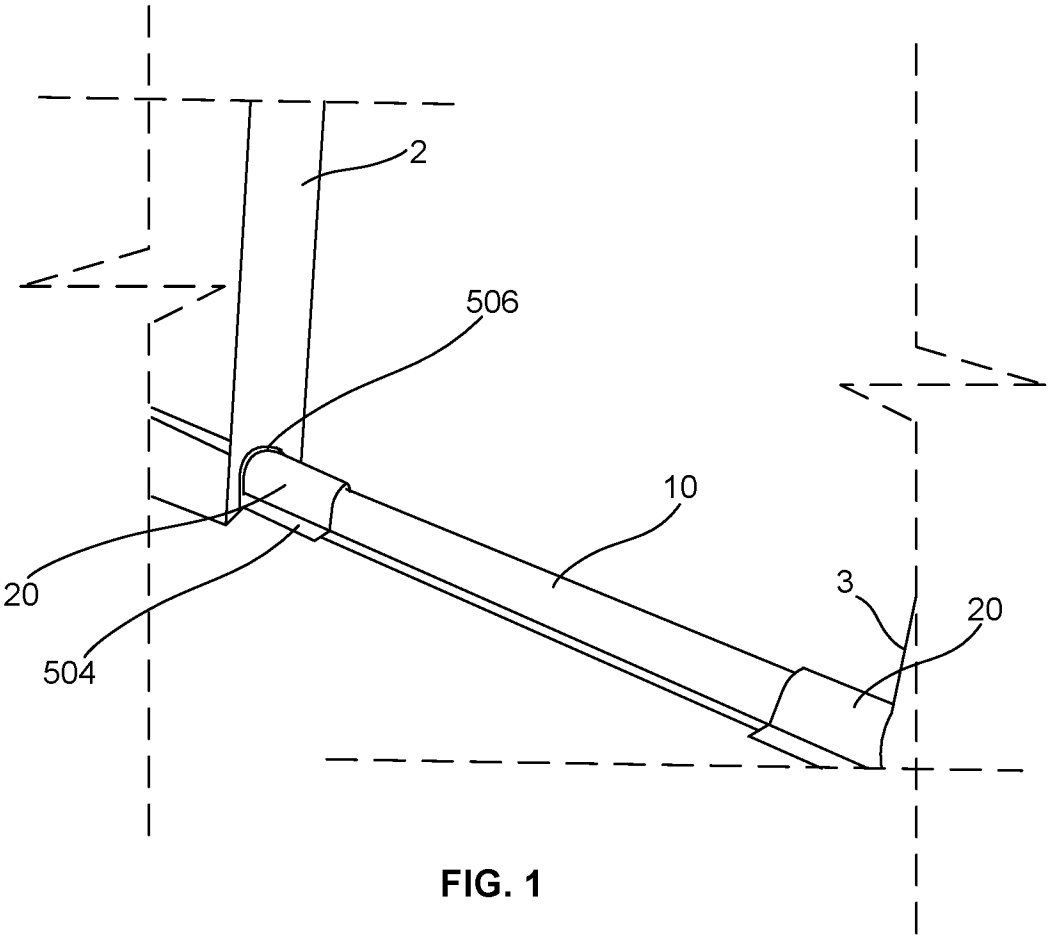
FIG. 1 is an illustration of a collapsible water dam installed on the base of a curbless shower stall with a 90-degree end wall in accordance with one or more embodiments of the present invention.
Figure 2:
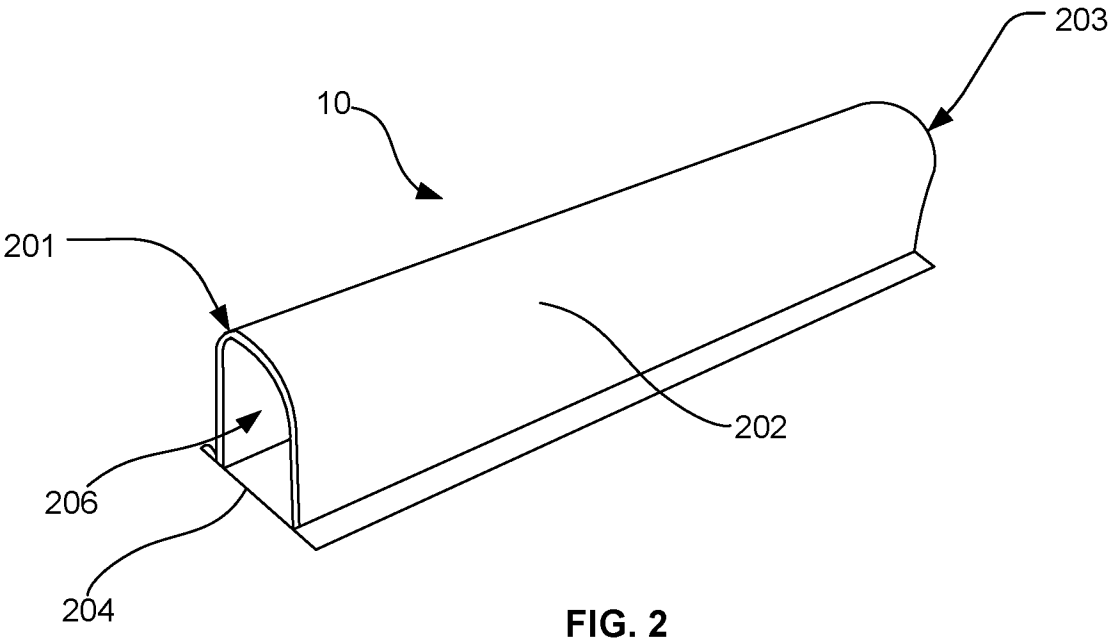
FIG. 2 is a cutout illustrating a collapsible water dam without the end caps of the present invention.
Figure 3:
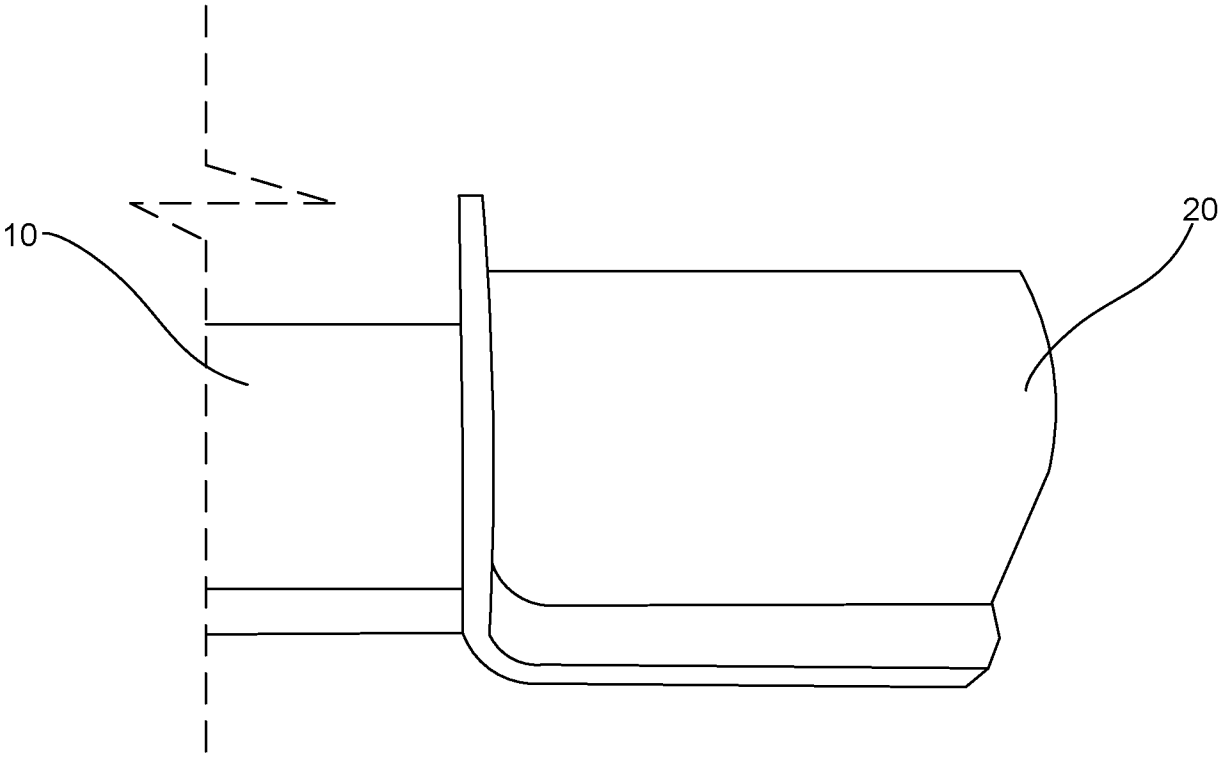
FIG. 3 is an illustration of an end cap for showers with 90-degree end walls coupled to a collapsible water dam in accordance with one or more embodiments of the present invention.
Figure 4:
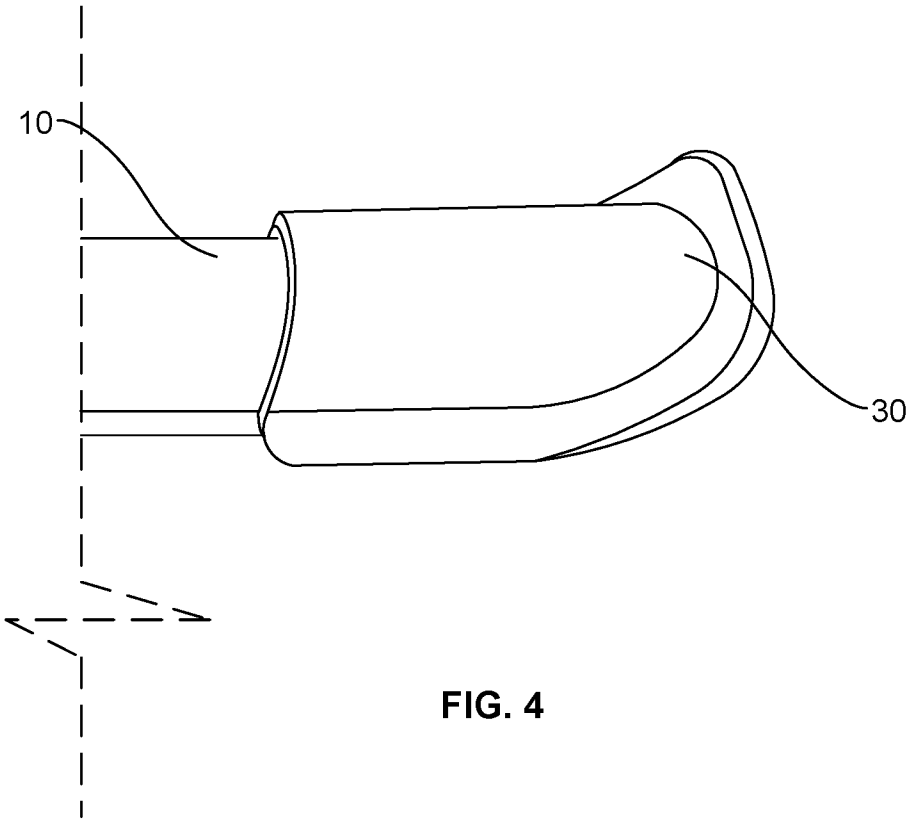
FIG. 4 is an illustration of an end cap with curved end walls coupled to a collapsible water dam in accordance with one or more embodiments of the present invention.
Figure 5A:
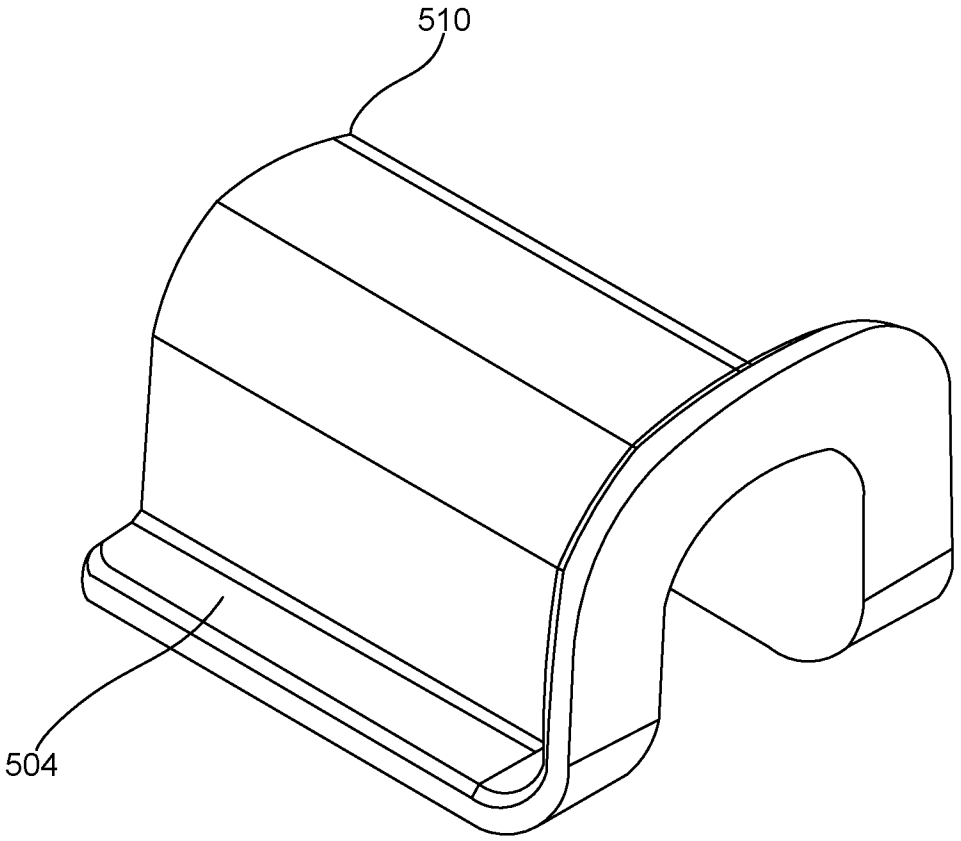
FIGS. 5A-5D are renderings of different views of the end cap 20 of FIG. 3.
Figure 5B:
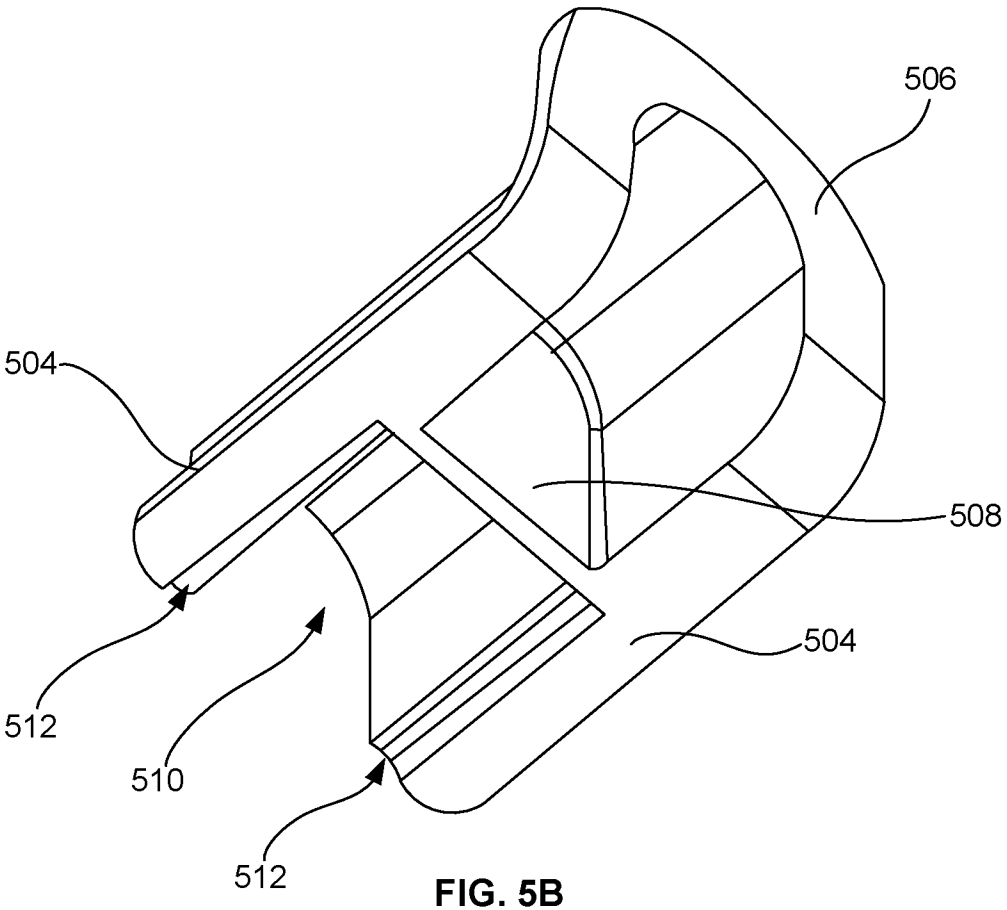
Figure 5C:
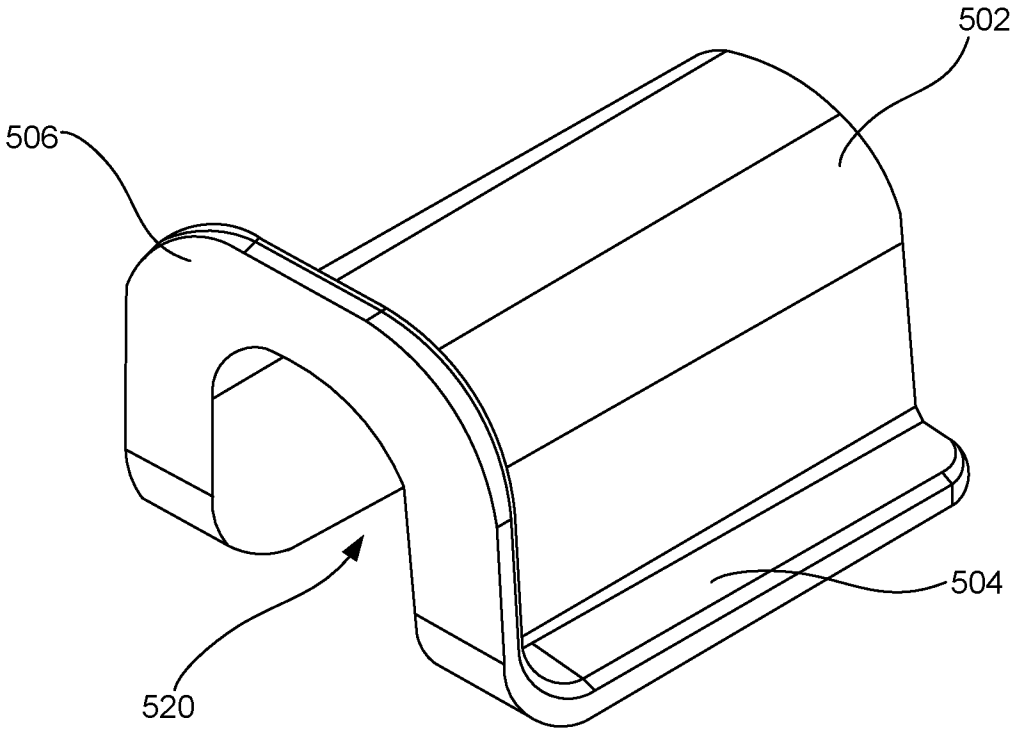
Figure 5D:
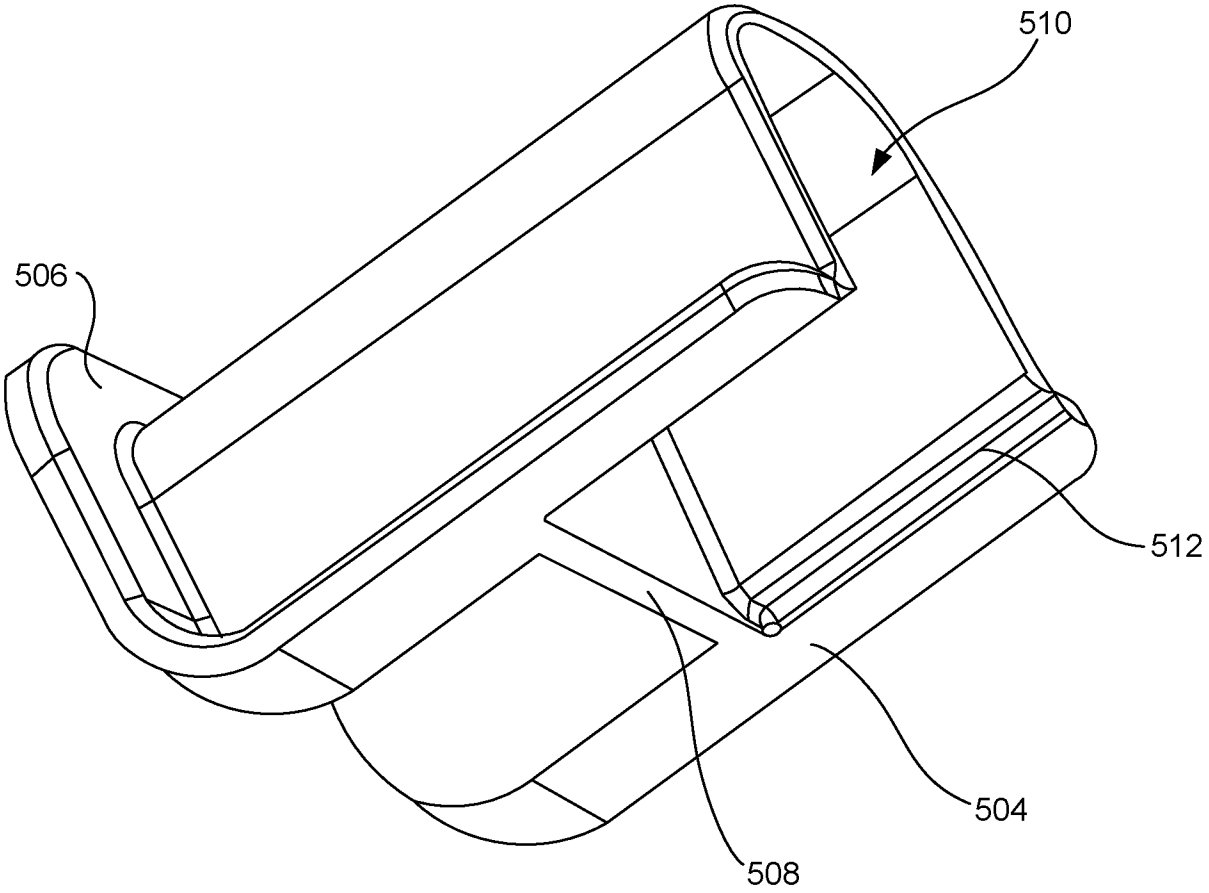
Figure 6A:
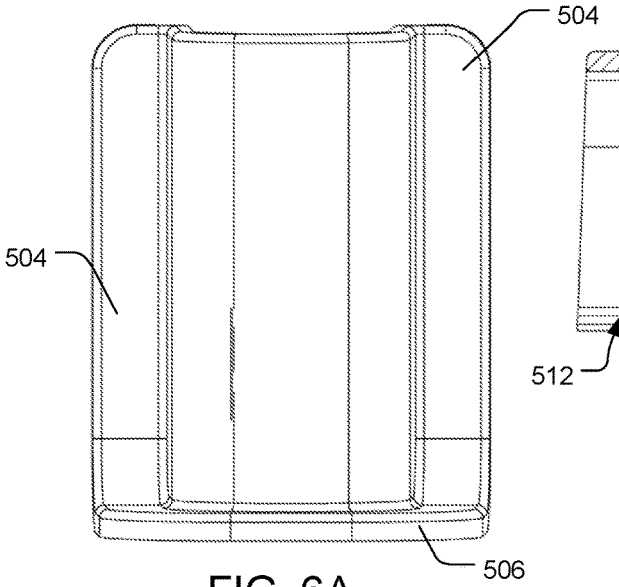
FIG. 6A is a top plan view of the end cap 20 of FIG. 3.
Figure 6C:
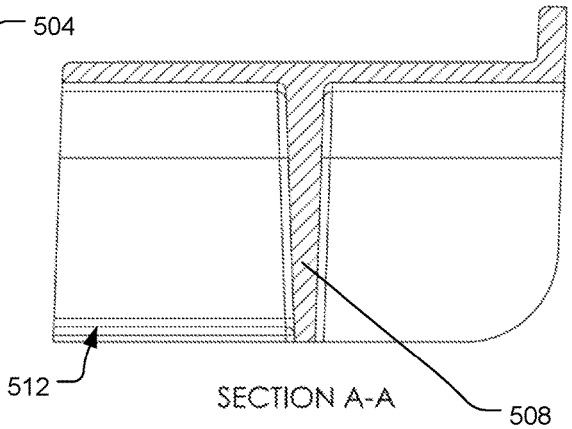
FIG. 6C is cross-sectional view A-A of the end cap 20 of FIG. 3.
Figure 6B:
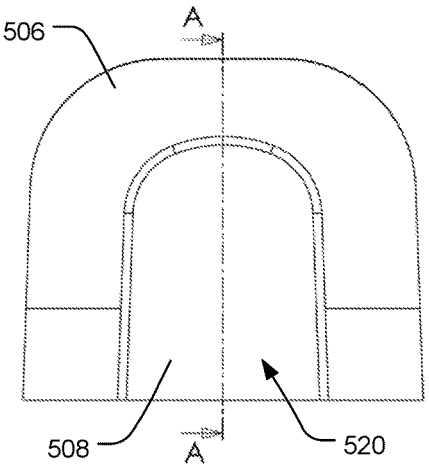
FIG. 6B is a rear elevational view of the end cap 20 of FIG. 3.
Figure 6D:
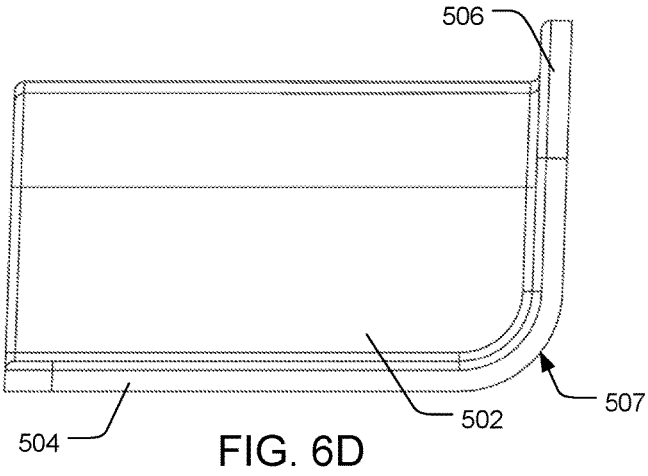
FIG. 6D is a side elevational view of the end cap 20 of FIG. 3.
Figure 6E:
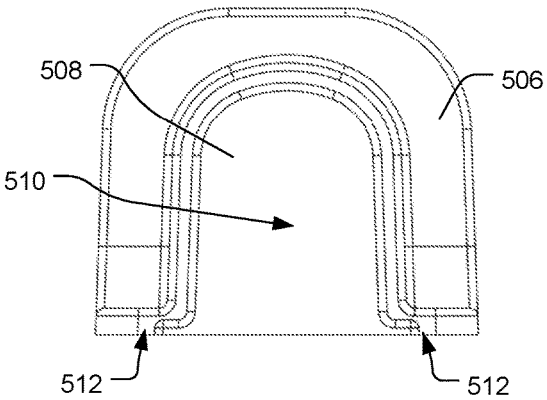
FIG. 6E is a front elevational view of the end cap 20 of FIG. 3.
Figure 7A:
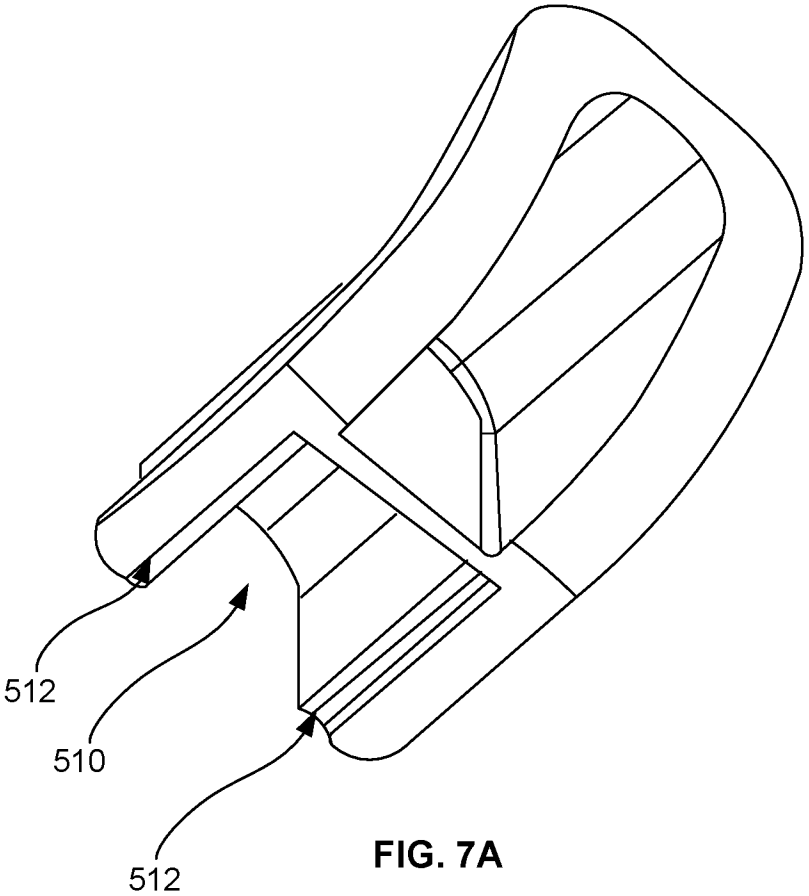
FIGS. 7A-7D are renderings of different views of the end cap 30 of FIG. 4.
Figure 7B:
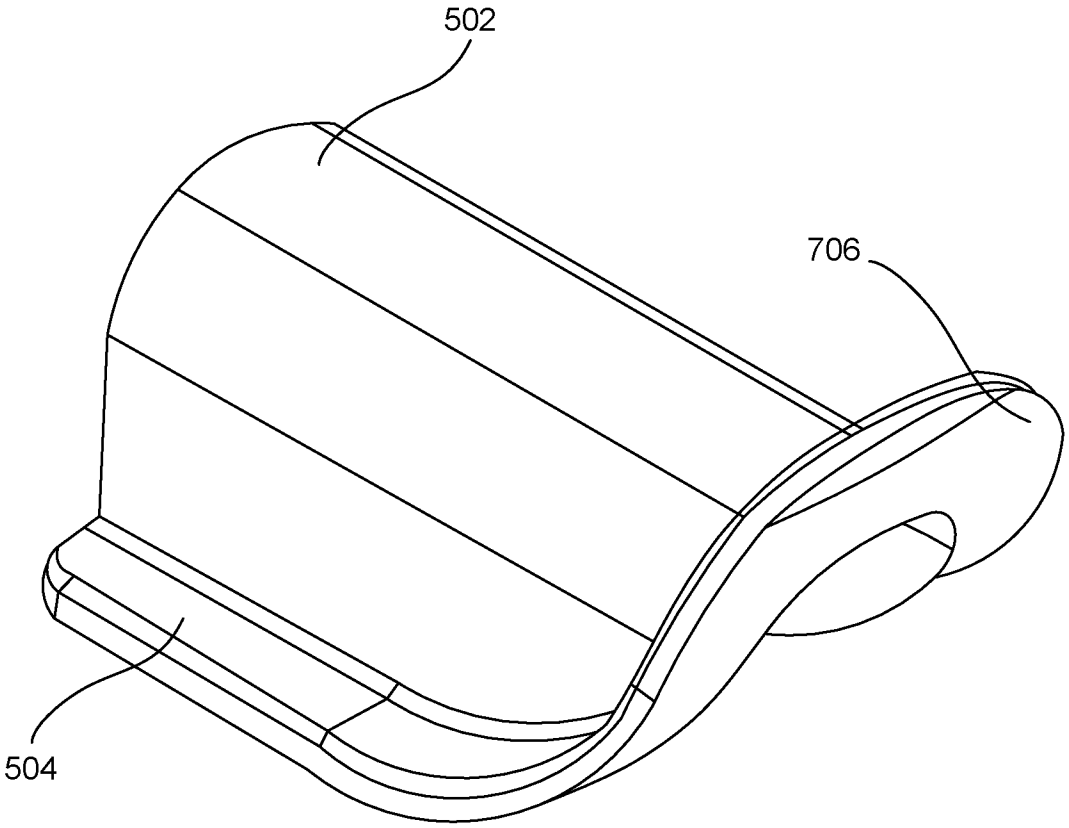
Figure 7C:
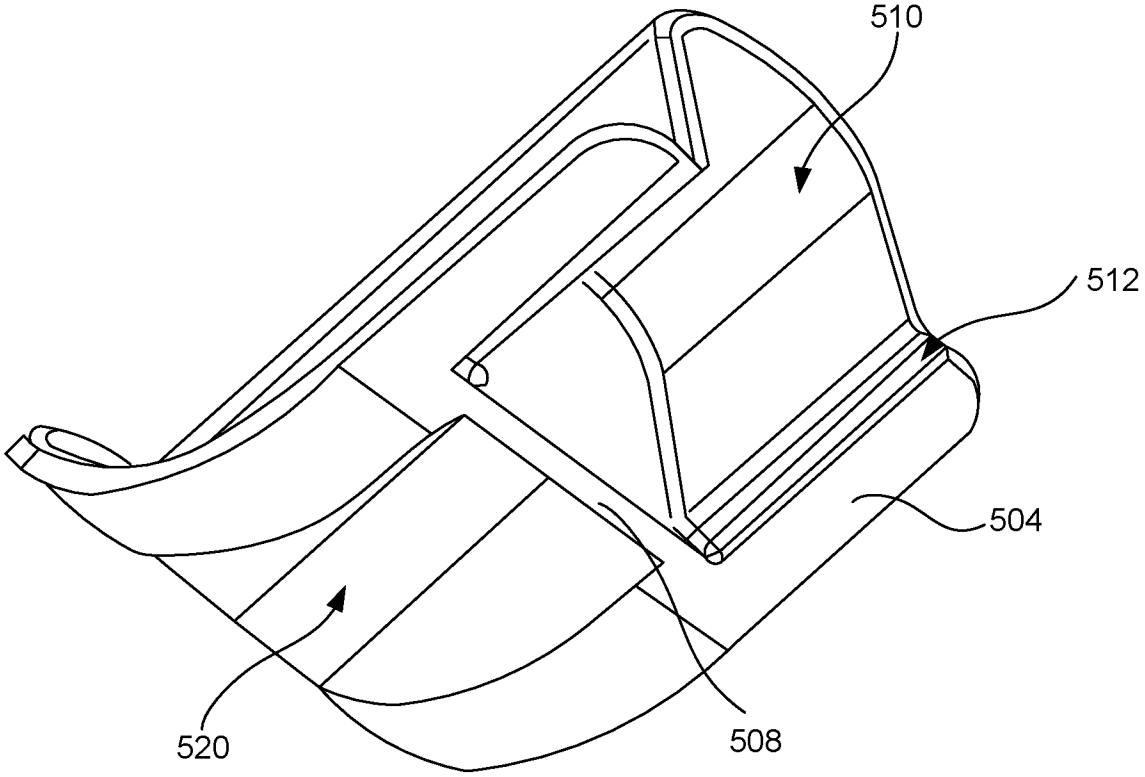
Figure 7D:
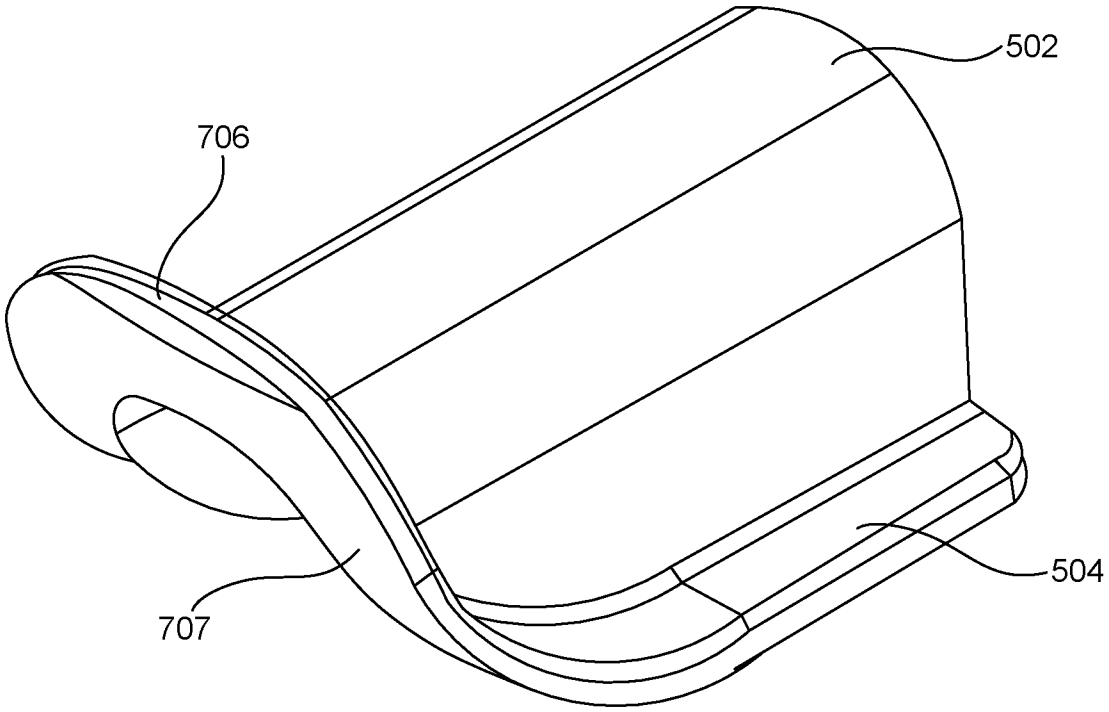
Figure 8A:
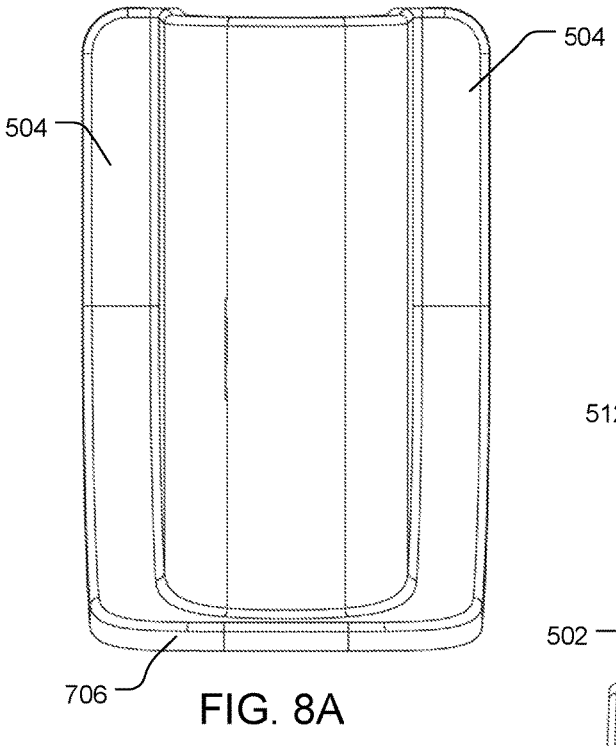
FIG. 8A is a top plan view of the end cap 30 of FIG. 4.
Figure 8C:
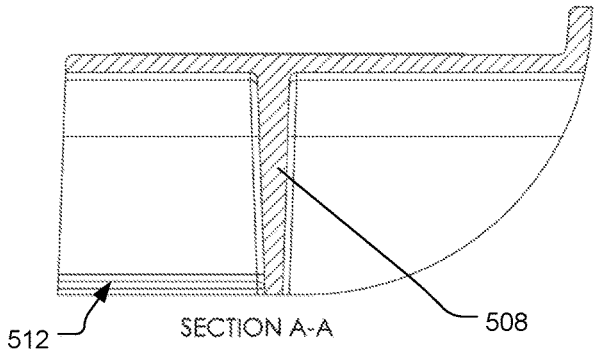
FIG. 8C is cross-sectional view A-A of the end cap 30 of FIG. 4.
Figure 8D:
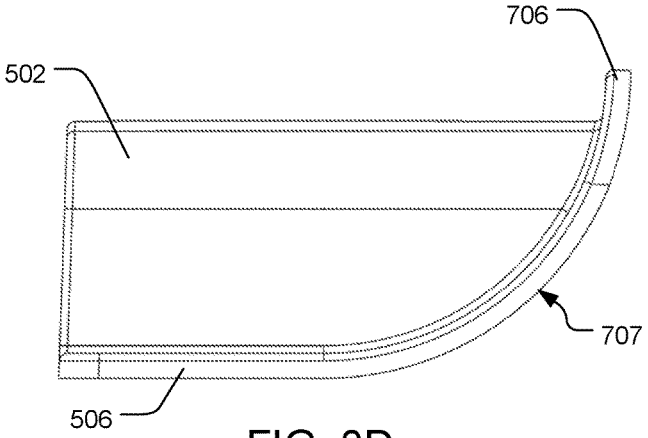
FIG. 8D is a side elevational view of the end cap 30 of FIG. 4.
Figure 8B:
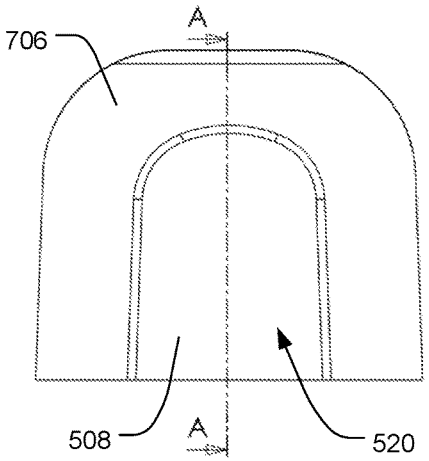
FIG. 8B is a rear elevational view of the end cap 30 of FIG. 4.
Figure 8E:
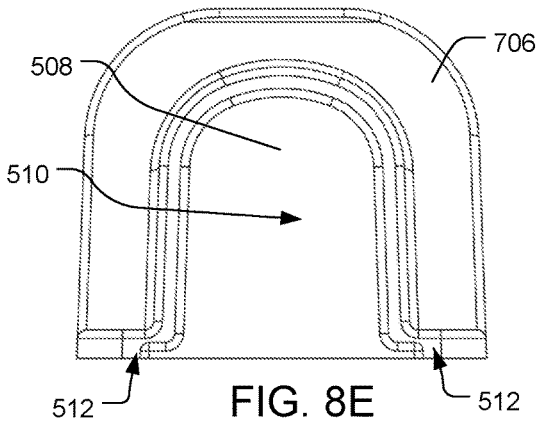
FIG. 8E is a front elevational view of the end cap 30 of FIG. 4.

Embodiments of the present invention comprise end-cap 20 that enable a tight fit enclosure for each one of the ends, i.e. a first end 201 and a second end 203, of a collapsible shower dam (or main member) 10 to keep water from flowing out of curbless showers and also to provide stability for the shower dam 10. As illustrated in FIG. 1, a first end cap, e.g. 20 or 30, is coupled to a first end 201 of the collapsible shower dam 10 and a second end cap, e.g. 20 or 30, is coupled to the second end 203 of the collapsible shower dam 10. As illustrated in FIG. 2, a typical shower dam 10 comprises a semi-cylindrical resilient upper portion 202 coupled to a bottom wall (or portion) 204 to form a hollow chamber (or longitudinal aperture) 206 therein, which extends the entire length of the collapsible shower dam 10. The bottom wall 204 extends beyond the outside periphery of the walls of the semi-cylindrical upper portion 202. The hollow inside chamber 206 facilitates collapsing of the shower dam when stepped on or rolled over, e.g. by a wheelchair.

In one or more embodiment of the present invention, each end-cap 20, e.g. as illustrated in FIGS. 5 and 6, comprises a semi-cylindrical housing 502 with an inside wall and outside wall; a side flange 504 on each side and coupled to the bottom outside periphery of the outside wall of housing 502. Side flange 504, on each side of the housing 502, extends from the proximal end of housing 502 towards the distal end where it couples with a wall flange 506. Thus, the wall flange 506 couples together the side flange from each side of the housing to act as one continuous member. As illustrated in FIG. 1, side flange 504 is configured to lay flat on the shower floor for coupling the end cap to the shower floor and wall flange 506 is configured to lay flat on the end-wall for coupling the end cap, e.g. 20, to the end-wall, e.g. 2 or 3, of the shower. The configuration and combination of side flange 504 and wall flange 506 adds stability to the collapsible water dam that is not present in the prior art.

In one or more embodiment of the present invention, the wall flange is configured to fit the shape of the end-wall. For example, the configuration of end cap, e.g. 20, comprises wall flange 506 with outside configuration 507 shaped to sit against a 90-degree end wall with very little radius between the shower floor and the end-wall. Another configuration of end cap, e.g. 30, comprises wall flange 706 with outside configuration 707 shaped to sit against a curved end wall with significant radius between the shower floor and the end-wall.

The end-cap, e.g. 20 or 30, further comprises a barrier wall 508 separating inner chamber 510 from inner chamber 520. The barrier wall 508 is configured as a stopper to prevent foreign objects, e.g. water, from entering the lumen 206 of the collapsible water dam thus preventing foreign materials from affecting its resiliency, in essence creating a secure chamber 510 for coupling the water dam. Chamber 510 is configured to accommodate collapsible water dam 10. Thus, chamber 510 includes a slot 512 on each side flange 504 to house or secure the exterior extensions of the bottom wall 204 of the collapsible water dam 10.

End-cap 20 is preferable made of a high performance elastomer in the thermoplastic rubber family, e.g. Santoprene® thermoplastic vulcanizates (TPV), which has excellent elastic recovery properties, and excellent chemical and temperature resistance. Those of skill in the arts would appreciate that other materials may be used without deviating from the spirit of the invention.

While the invention herein disclosed has been described by means of specific embodiments and applications thereof, numerous modifications and variations could be made thereto by those skilled in the art without departing from the scope of the invention set forth in the claims.

What is claimed is:

1. A floor-based collapsible water retainer for a curbless shower stall to inhibit water infiltration to an exterior area that is outside of the shower stall, the shower stall having a shower stall floor and first and second opposing end walls adjoining the exterior area, comprising:

a main member made of a resilient material extending longitudinally between a first end and a second end, the main member having an upper portion and a bottom portion, the upper portion having a longitudinal aperture between the first end and the second end, the bottom portion adapted to be secured to the shower stall floor;

a first end cap adapted to be removably secured to the first end of the main member;

a second end cap adapted to be removably secured to the second end of the main member;

wherein the first end cap and the second end cap are removably secured to the main member, the first end cap is in contact with the first opposing end wall and the second end cap is in contact with the second opposing end wall to inhibit water infiltration to the exterior area from the shower stall when the bottom portion of the main member is secured to the shower stall floor between the opposing end walls of the shower stall; and wherein the upper portion of the main member flexes when engaged by a wheelchair transiting between the shower stall and the exterior area and subsequently returns to an unflexed position to continue to substantially inhibit water infiltration to the exterior area from the shower stall.

2. The collapsible water retainer of claim 1 wherein at least the first end cap includes a flat securing portion to inhibit water infiltration to the exterior area from the shower stall.

3. The collapsible water retainer of claim 1 wherein at least the first end cap includes a arcuate securing portion to inhibit water infiltration to the exterior area from the shower stall.

4. The collapsible water retainer of claim 1 wherein at least the first end cap includes a barrier wall.

5. A collapsible water retainer for an open shower stall to inhibit water infiltration to an exterior area that is outside of the shower stall, the shower stall having a shower stall floor and opposing end walls adjacent to the exterior area, comprising:

a main member made of a resilient material extending longitudinally between a first end and a second end, the main member having an upper portion and a bottom portion, the upper portion having a longitudinal aperture between the first end and the second end, the upper portion having a lateral height transverse to the longitudinal direction of the main member that is greater than the anticipated lateral height of water to be expected in the shower stall, the bottom portion adapted to be secured to the shower stall floor;

a first end cap that is removably secured to the first end of the main member;

a second end cap that is removably secured to the second end of the main member;

the first end cap and the second end cap adapted to be removably secured to the respective first and second ends of the main member and placed adjoining the opposing end walls of the shower stall to inhibit water infiltration to the exterior area from the shower stall when the bottom portion of the main member is secured to the shower stall floor between the opposing end walls of the shower stall; and wherein the upper portion of the main member (i) flexes when engaged by a wheelchair transiting between the shower stall and the exterior area and (ii) subsequently returns to the upper portion's lateral height to continue to inhibit water infiltration to the exterior area from the shower stall.

* * * * *